United States Patent [19]

Kikuchi et al.

[11] Patent Number: 4,865,523

[45] Date of Patent: Sep. 12, 1989

[54] WOBBLE PLATE COMPRESSOR WITH VARIABLE DISPLACEMENT MECHANISM

[75] Inventors: Sei Kikuchi; Kiyoshi Terauchi; Kazuhiko Takai; Teruo Higuchi, all of Gunma, Japan

[73] Assignee: Sanden Corporation, Gunma, Japan

[21] Appl. No.: 157,784

[22] Filed: Feb. 19, 1988

[30] Foreign Application Priority Data

Feb. 19, 1987 [JP] Japan ..... 62-36446

[51] Int. Cl.[4] ..... F04B 1/26

[52] U.S. Cl. ..... 417/222; 417/270; 417/269

[58] Field of Search ..... 417/222.05, 269, 270; 92/12.2

[56] References Cited

U.S. PATENT DOCUMENTS

| | | | |
|---|---|---|---|
| 2,964,234 | 12/1960 | Loomis, III | 74/60 |
| 4,664,604 | 5/1987 | Terauchi | 417/222 |
| 4,674,957 | 6/1987 | Ohta | 417/222 S |
| 4,729,718 | 3/1988 | Ohta | 417/222 S |

*Primary Examiner*—William L. Freeh

*Attorney, Agent, or Firm*—Banner, Birch, McKie & Beckett

[57] ABSTRACT

A wobble plate compressor with a variable displacement mechanism is disclosed. The compressor includes a compressor housing having a crank chamber and a cylinder block. A plurality of cylinders is formed in the cylinder block. A drive shaft is rotatably supported in the housing. A rotor is fixed on the drive shaft and is hingedly connected to an inclined plate through a hinge mechanism. The hinge mechanism includes a first arm portion which is formed on either the rotor or inclined plate, a second arm portion having an elongated hole on the other of the rotor or the inclined plate, and a guide pin fixedly disposed in the hole of the first arm portion. A wobble portion is disposed adjacent the inclined plate and converts rotational motion of the inclined plate into nutational motion. A plurality of pistons are coupled to the wobble plate through a plurality of piston rods. Each piston is reciprocatingly fitted within a respective one of the cylinders. The stroke volume of the pistons changes according to the variation of the angle of the angle of the inclined plate. The elongated hole is formed so that the top clearance of the piston is a minimum when the angle of the inclined plate is largest, and the top clearance of the piston is a maximum when the angle of the inclined plate is smallest. The elongated hole is oriented in a manner that while the range of the inclined angles of the inclined plate is small, the capacity range variance for the compressor is large.

20 Claims, 8 Drawing Sheets

WOBBLE PLATE COMPRESSOR WITH VARIABLE DISPLACEMENT MECHANISM

TECHNICAL FIELD

The present invention relates to a wobble plate compressor with a variable displacement mechanism. More particularly, the present invention relates to a hinge mechanism for a variable displacement mechanism.

BACKGROUND OF THE INVENTION

A wobble plate compressor which reciprocates pistons by converting rotational movement of a cam rotor into nutational movement of a wobble plate is well known as shown in Japanese Patent Application Publication No. 58-158,382. Changing the inclined angle of the wobble plate changes the stroke length of the pistons and therefore changes the displacement volume of the cylinders.

Referring to FIGS. 1 and 2, a conventional variable displacement wobble plate compressor 1 includes front end plate 2, cylinder casing 3, valve plate 4, and cylinder head 5. Front end plate 2 is fixed on one end of cylinder casing 3 by securing bolts (not shown). Axial hole 21, which is formed through the center of front end plate 2, receives drive shaft 7. Radial bearing 8 is disposed in axial hole 21 to rotatably support drive shaft 7. An annular sleeve portion (not shown) projects from front end plate 2 and surrounds drive shaft 7, defining a seal cavity. Cylinder casing 3 has cylinder block 31 and crank chamber 32 formed therein. Cylinder block 31 has a plurality of equiangularly spaced cylinders 33 formed therein.

Cam rotor 9 is fixed on drive shaft 7 by guide pin 103. Thrust needle bearing 10 is disposed between the inner wall surface of front end plate 2 and the adjacent axial end surface of cam rotor 9. Arm portion 91 of cam rotor 9 extends in the direction of cylinder block 31. Elongated hole 92 is formed on arm portion 91. Inclined plate 11, is provided with flange portion 111, arm portion 112 and cylindrical portion 113 disposed around drive shaft 7. Arm portion 112 is formed on the outer surface of flange portion 111 and faces arm portion 91 of cam rotor 9. Hole 119 is formed in arm portion 112 and aligns with elongated hole 92. Guide pin 12, which is fixedly disposed through hole 119, is slidably movable within elongated hole 92. Ring-shaped wobble plate 13 is mounted on the outer surface of cylindrical portion 113 of inclined plate 11 through radial bearing 14. Inclined plate 11 and wobble plate 13 are disposed at an angle with respect to a plane perpendicular to the longitudinal axis of drive shaft 7. Flange portion 111 and snap ring 15 disposed on cylindrical portion 113 prevent axial movement of wobble plate 13. Wobble plate 13 is prevented from rotating by guide plate 25 which extends within crank chamber 32. Thrust needle bearing 16 is disposed in a gap between flange portion 111 and wobble plate 13. The other end of drive shaft 7 is rotatably supported through radial bearing 17 in central bore 34 of cylinder block 31. One end of piston rod 18 is rotatably connected to receiving surface 131 of wobble plate 13. The other end of piston rod 18 is rotatably connected to piston 19 which is slidably fitted within cylinder 33.

Suction ports 41 and discharge ports 42 are formed through valve plate 4 with one suction port 41 and one discharge port 42 corresponding to each cylinder 33. Suction reed valve (not shown) is disposed on valve plate 4. Discharge reed valve (not shown) is disposed on valve plate 4 opposite the suction reed valve. Cylinder head 5 is connected to cylinder casing 3 through gaskets (not shown) and valve plate 4. Partition wall 51 extends axially from the inner surface of cylinder head 5 and divides the interior of cylinder head 5 into suction chamber 52 and discharge chamber 53. Suction chamber 52 is connected to the external fluid circuit through fluid inlet port 54 formed in cylinder head 5. Discharge chamber 53 is connected to the external fluid circuit through fluid outlet port 55 formed in cylinder head 5.

Crank chamber 32 of cylinder casing 3 and suction chamber 52 of cylinder head 5 communicate with each other through conduit 311 and hollow portion 312 formed within cylinder block 31. This communication controls the angle of inclined plate 11 and wobble plate 13. Refrigerant fluid in crank chamber 32 flows to suction chamber 52 through conduit 311 and hollow portion 312 based on the operation of control valve 20. Control valve 20 opens and closes conduit 311 in response to the gas pressure in crank chamber 32. The angle of inclined plate 11 and wobble plate 13 varies in accordance with the opening and closing of conduit 311. When control valve 20 closes conduit 311 the gas pressure in crank chamber 32 gradually increases. The higher gas pressure acts on the rear surface of piston 19 to reduce the angle of inclined plate 11 and to reduce the capacity of the compressor. When control valve 20 opens conduit 311, the gas pressure in crank chamber 32 reduces thereby increasing the angle of inclined plate 11 and wobble plate 13. This increases the capacity of the compressor.

In the conventional hinge mechanism of these known compressors elongated hole 92 of arm portion 91 of cam rotor 9 is arc-shaped. The center of the arc is adjacent the connecting portion of wobble plate 13. Arm portion 112 of inclined plate 11 has hole 119, and guide pin 12 extends from hole 119.

The end of the radius of curvature of the arc of elongated hole 92 is located adjacent the connecting portion, receiving surface 131, of wobble plate 13. Thus, the axial distance between the center of guide pin 12 when the angle of inclined plate 11 is largest and when the angle is smallest is very short. The radial distance is many times longer. Also, the top clearance is the clearance between the top of piston 19 and the inner end surface of valve plate 4 at top dead center for maximum and minimum piston strokes and accounts for the re-expansion volume. The re-expansion volume is inversely proportional to the volumetric efficiency of the compressor. Accordingly, although inclined plate 11 varies from the largest angle to the smallest angle, the top clearance varies only slightly. It is necessary to greatly reduce the angle of inclined plate 11 to decrease the refrigerating capacity of the compressor.

Furthermore, when the angle of inclined plate 11 is smallest, piston 19 does not perform compression, and the reaction force against the compression force does not act on the end surface of piston 19. Therefore, it is necessary to use a return spring or similar device to return inclined plate 11 to its largest angle adjacent the side of cam rotor 9.

SUMMARY OF THE INVENTION

It is an object of this invention to provide a wobble plate compressor with a variable displacement mechanism which controls the refrigerating capacity over a wide range while varying the angle of the inclined plate over a narrow range.

It is another object of this invention to provide a wobble plate compressor with a variable displacement mechanism which has a hinge mechanism which rapidly returns the inclined plate to its largest angle position in response to reducing the gas pressure in the crank chamber.

A wobble plate compressor with a variable displacement mechanism according to the present invention includes a compressor housing having a crank chamber and a cylinder block in which a plurality of cylinders are also formed. A drive shaft is rotatably supported in the housing. A rotor is fixed on the drive shaft for rotation therewith and is hingedly connected to an inclined plate through a hinge mechanism. The hinge mechanism includes a first arm portion having a hole formed on either the rotor or the inclined plate, a second arm portion having an elongated hole formed on the other of the rotor or the inclined plate, and a guide pin extending from the hole of the first arm portion. A wobble plate is disposed on the drive shaft adjacent the inclined plate and converts rotational motion of the inclined plate into nutational motion. A plurality of pistons are coupled to the wobble plate through a plurality of piston rods. Each piston is reciprocatingly fitted within a respective one of the cylinders. The stroke volume of the pistons changes according to the variation of the angle of the inclined plate. The elongated hole in the second arm portion is formed so that the top clearance of the piston is a minimum when the angle of the inclined plate is the largest or at its maximum, and the top clearance of the piston is a maximum when the angle of the inclined plate is smallest or at its minimum. The top clearance at small (non-maximum) inclined plate angles is greater than in prior art compressors. Additionally, the ends of the elongated hole lie along a uniform arc having a central radius of curvature extending below the center of the wobble plate-piston rod connecting portion. The arc is symmetric around, and has its radius of curvature colinear with, a line perpendicular to the line segment between the ends.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF THE INVENTION

Figure 2:
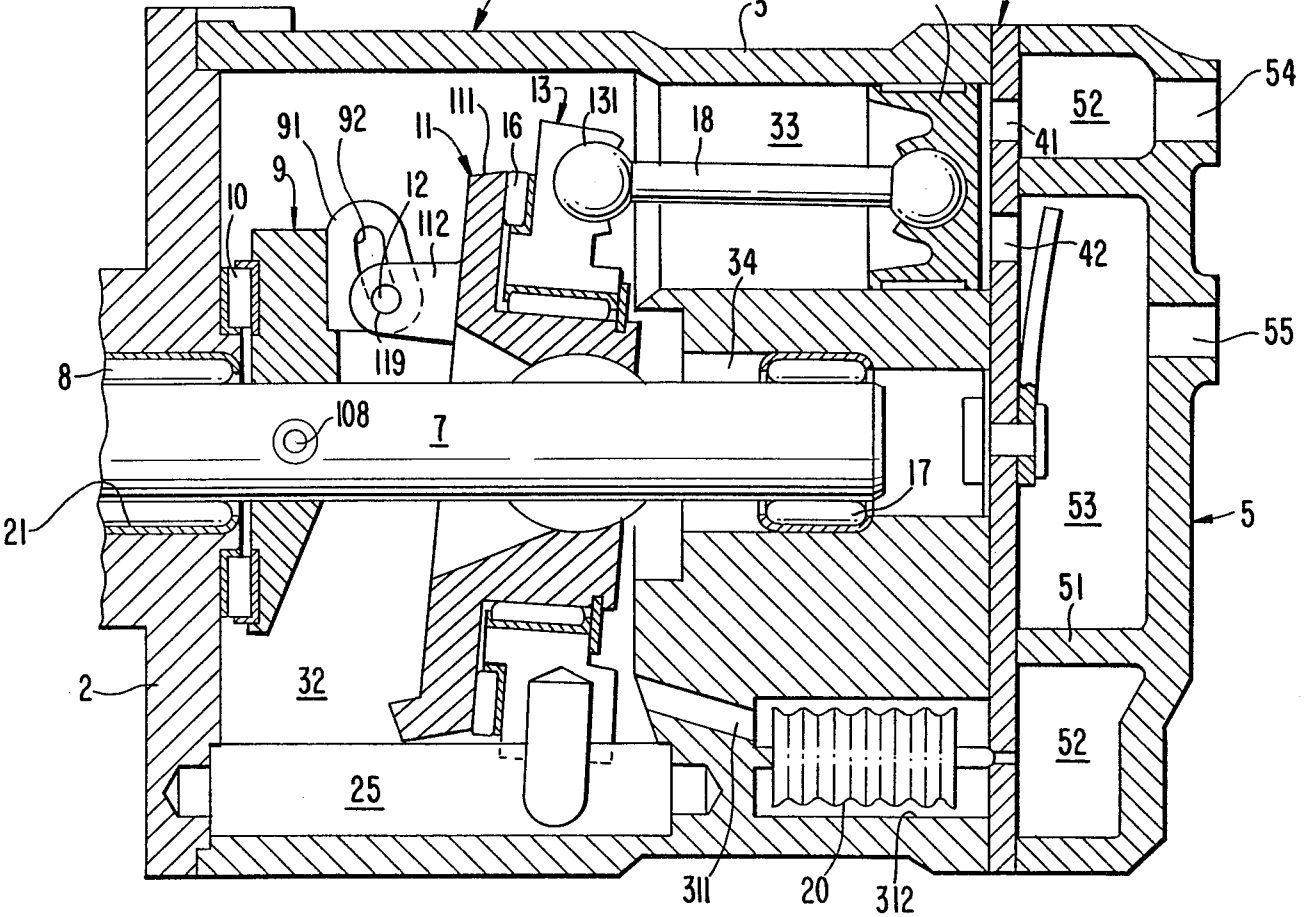
FIG. 2 PRIOR ART
FIG. 2 is a cross-sectional view of the wobble plate compressor of FIG. 1 showing the smallest angle of the inclined plate.
Figure 3:
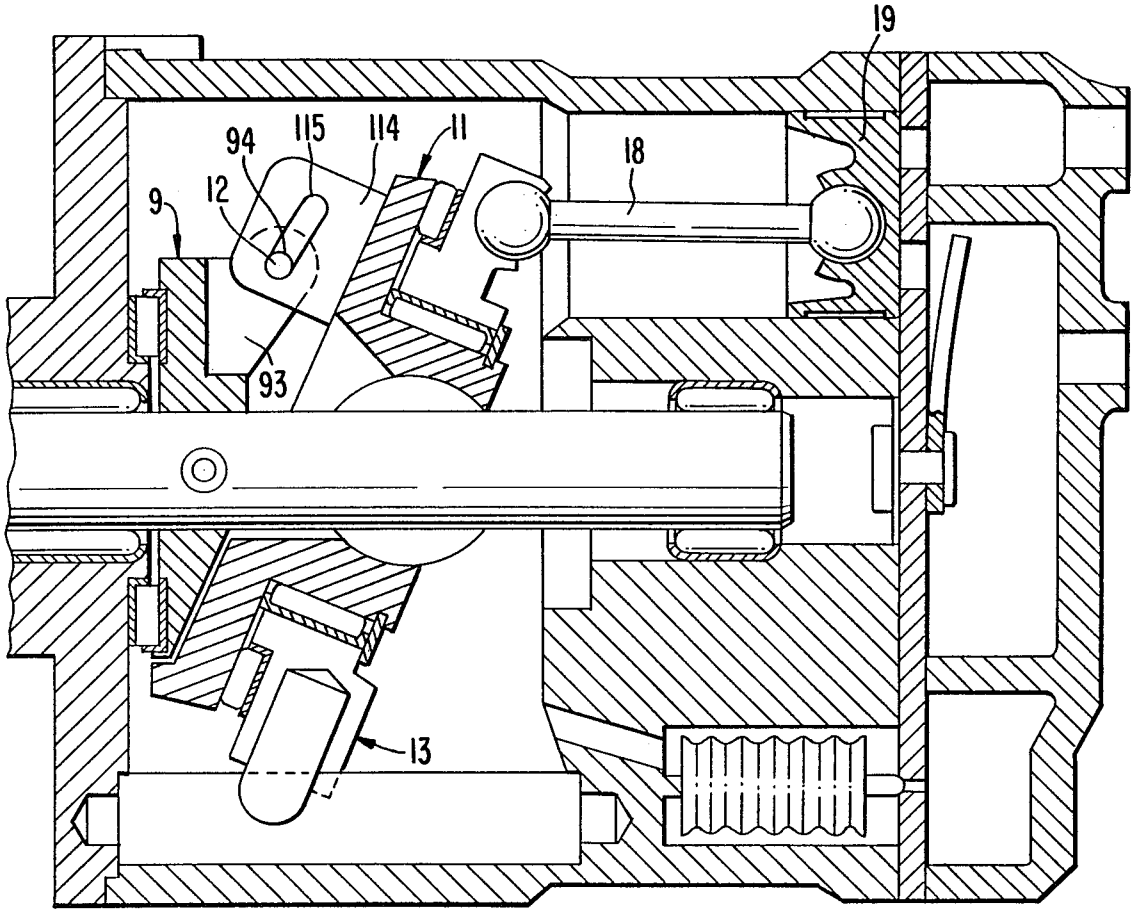
FIG. 3 is a cross-sectional view of a wobble plate compressor with a variable displacement mechanism in accordance with one embodiment of this invention, showing the largest angle of the inclined plate.
Figure 4:
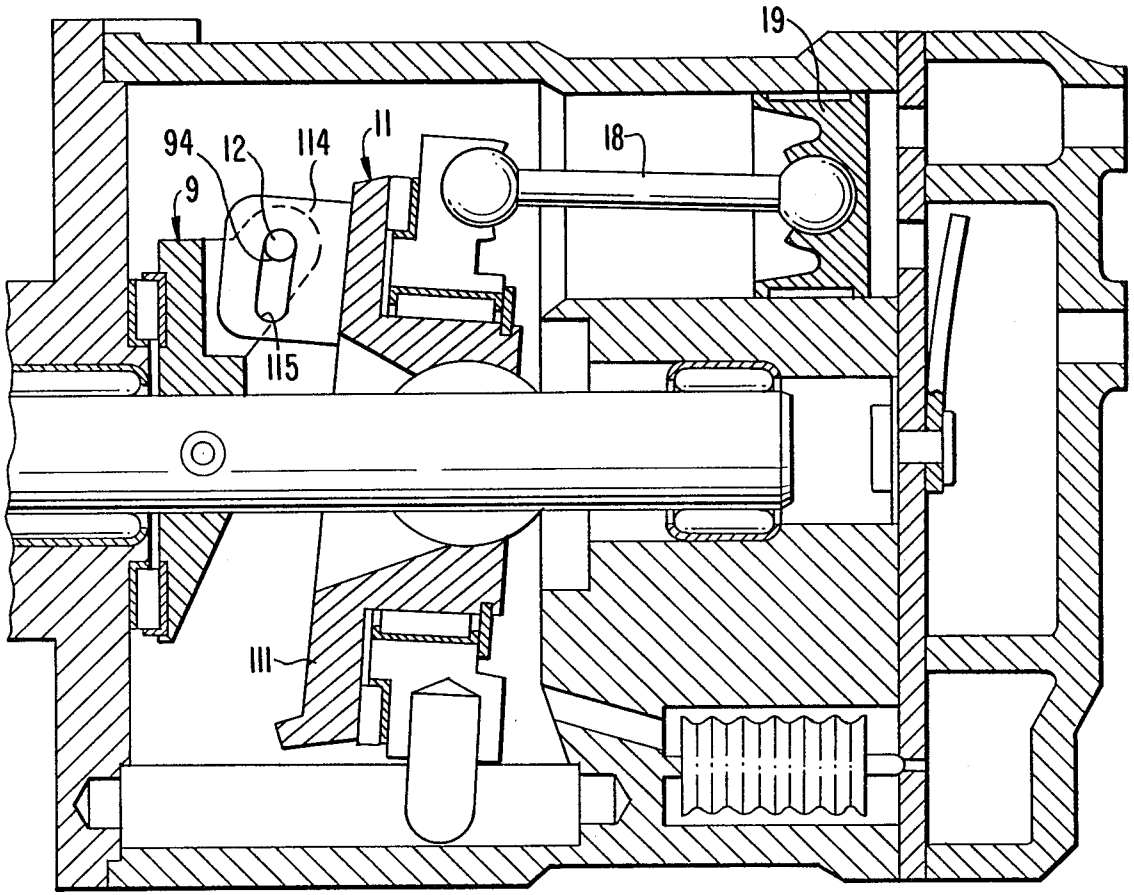
FIG. 4 is a cross-sectional view of the wobble plate compressor of FIG. 3 showing the smallest angle of the inclined plate.

FIGS. 3 and 4 illustrate one embodiment of the wobble plate compressor with a variable displacement mechanism of the present invention. Like numerals refer to like elements in FIGS. 1 and 2 described in the "Background of the Invention" section. A hinge mechanism, used in the drive mechanism, includes arm portion 93 of cam rotor 9 and arm portion 114 of inclined plate 11. Arm portion 93 is provided with hole 94 and arm portion 114 is provided with arc-shaped elongated hole 115. The hinge mechanism also includes guide pin 12 extending from hole 94. Guide pin 12 is inserted into elongated hole 115 and controls the angle of inclined plate 11 within the range of elongated hole 115. Elongated hole 115 is shaped so that the top clearance of piston 19 is smallest when the angle of inclined plate 11 is largest and the top clearance of piston 19 is largest when the angle of inclined plate is the smallest. The orientation of elongated hole 115 increases the top clearance when the compressor operates at smaller angles.

Figure 5:
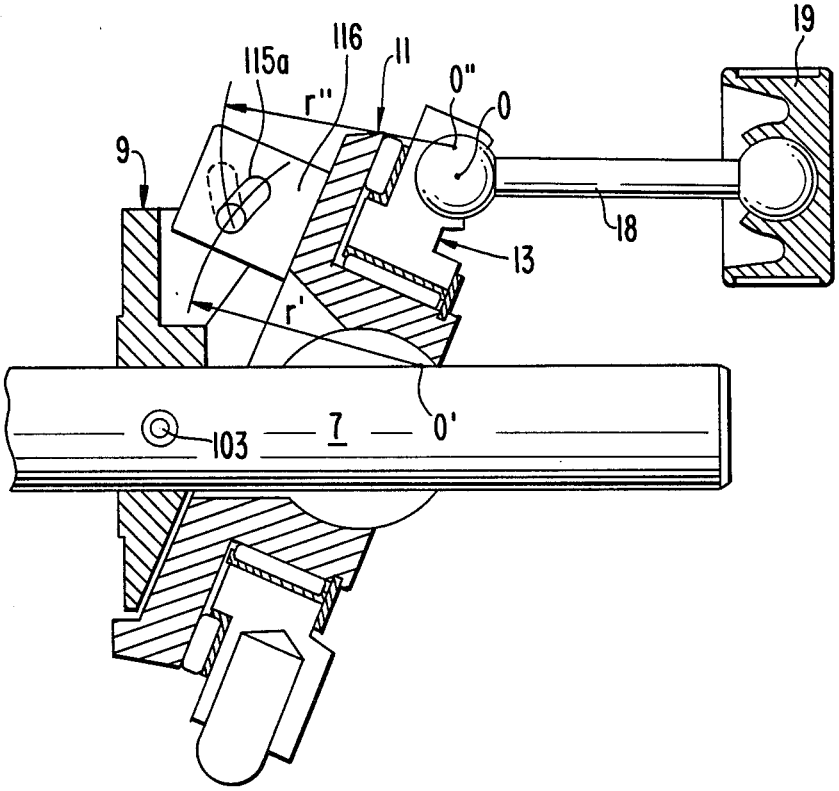
FIG. 5 is a cross-sectional view of the drive mechanism of a wobble plate compressor with a variable displacement mechanism in accordance with another embodiment of this invention illustrating the shape of the elongated hole used in the hinge mechanism.

FIG. 5 illustrates an alternate shape of the elongated hole. In FIG. 5 characteristics for the invention present in both the embodiment of FIGS. 3 and 4 and the embodiment of FIG. 5 are shown. Center O″ is the center of the radius of curvature of the arc of elongated hole 92, shown by a dotted line, of known compressors such as that of FIGS. 1 and 2. Center O″ is located adjacent center O of the connecting portion between piston rod 18 and wobble plate 13 (receiving surface 131 or the approximate center of the ball at the end of piston rod 18) when the angle of inclined plate 11 is largest. Center O′ of the radius of curvature of the circular arc of elongated hole **115*a* formed through arm portion 116 extends below the connecting portion of piston rod 18 and wobble plate 13 and its center is located adjacent the top surface of drive shaft 7 when the angle of inclined plate 11** is largest.

The embodiment of FIG. 5 differs from that of FIGS. 3 and 4 in that the shape of the arc of elongated hole **115*a* differs from that of elongated hole 115. However, the ends of the radii of curvature for both arcs lies adjacent the outer surface of drive shaft 7 when inclined plate 11 is at its largest angle. In both embodiments the ends of the elongated hole lie along a uniform arc. This arc or curve is shown and described as circular. However, the arc need not be circular. The arc may be any arc having a radius at its center point extending below the connecting portion of piston rod 18 and wobble plate 13**.

Figure 6:
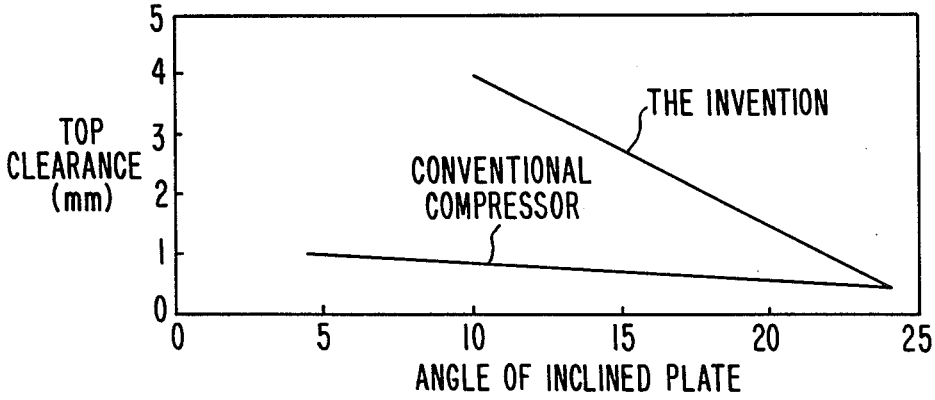
FIG. 6 is a graph illustrating the relationship between the top clearance of the piston and the angle of the inclined plate.

Because of the orientation of elongated hole 115*a*, the difference between the top clearances of piston 19 increases as compared to conventional wobble plate compressors as shown graphically in FIG. 6. That is, the top clearance for a given smaller (non maximum) angle is greater in the present invention than in prior compressors, assuming the top clearance at maximum inclined plate angles is substantially the same. Although the difference in top clearances is small in conventional compressors, the difference is relatively large in the present invention. The re-expansion volume is proportional to the top clearance of the piston. In the compressor of the present invention, if the angle of inclined plate 11 is reduced, the compression volume of the compressor decreases. This increases the top clearance as shown in FIG. 6, thereby increasing the re-expansion volume.

Figure 7:
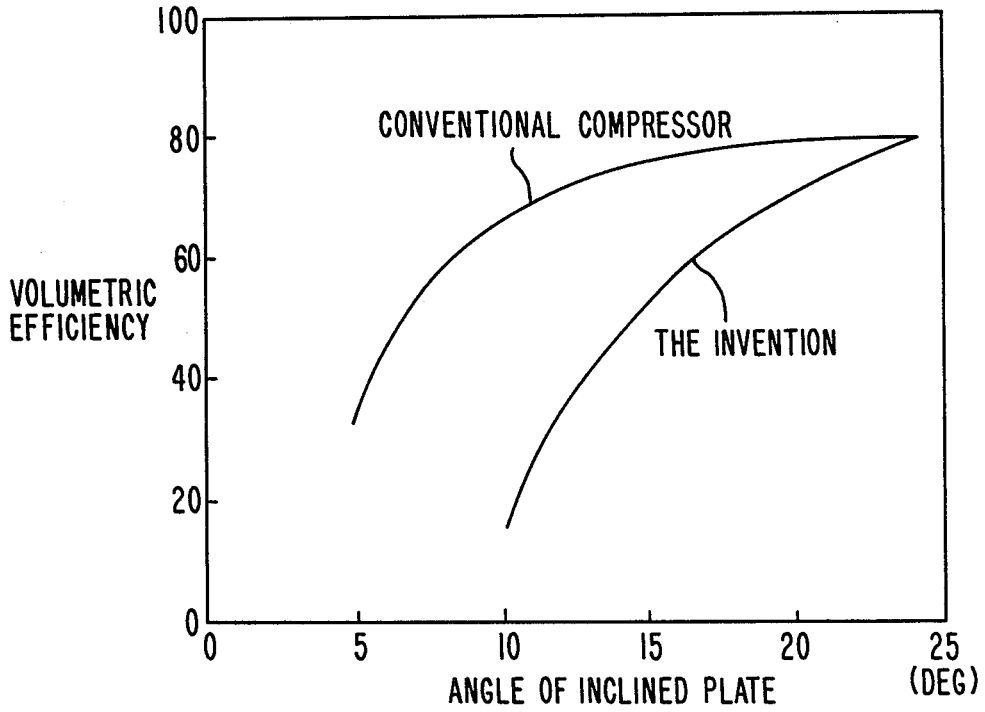
FIG. 7 is a graph illustrating the relationship between the volumetric efficiency of the compressor and the angle of the inclined plate.
Figure 8:
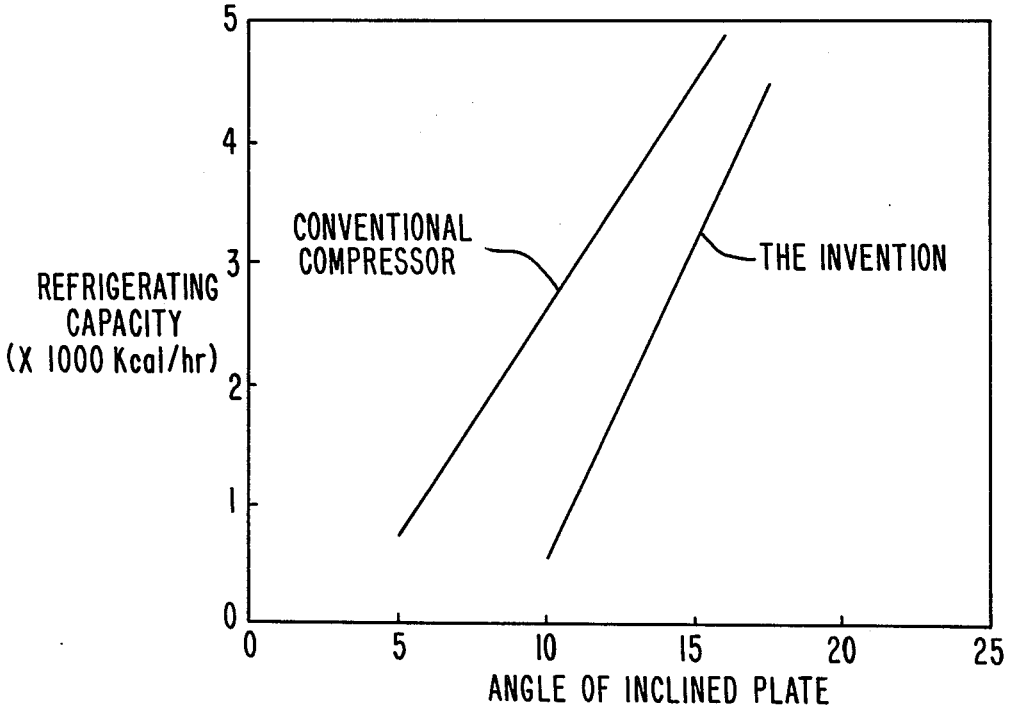
FIG. 8 is a graph illustrating the relationship between the refrigerating capacity of the compressor and the angle of the inclined plate.

Referring to FIG. 7, the relationship between volumetric efficiency and the angle of the inclined plate is shown. The graph of FIG. 7 is based on the following compressor operating conditions: the discharge chamber pressure is 8 kg/cm G, the suction chamber pressure is 2 kg/cm G, and the rotational speed of inclined plate 11 is 2000 rpm. Since the re-expansion volume increases with a decreasing inclined plate 11 angle, the volumetric efficiency of the compressor rapidly decreases. The refrigerating capacity of the compressor also rapidly decreases with small changes in the inclined plate 11 angle as shown in FIG. 8 which is based on the same compressor operating conditions.

Accordingly, a wide range for the refrigerating capacity can be attained with a smaller variation range for the angle of inclined plate 11. Furthermore, since the inclined plate angle is larger than that of conventional compressors when the angle of the inclined plate is smallest, inclined plate 11 easily returns toward the position of the largest angle. The re-expansion volume is increased and the volumetric efficiency is decreased at lower inclined plate angles when center O' of the arc of elongated hole 115*a* is located below the center of the connecting portion of the wobble plate.

Figure 9:
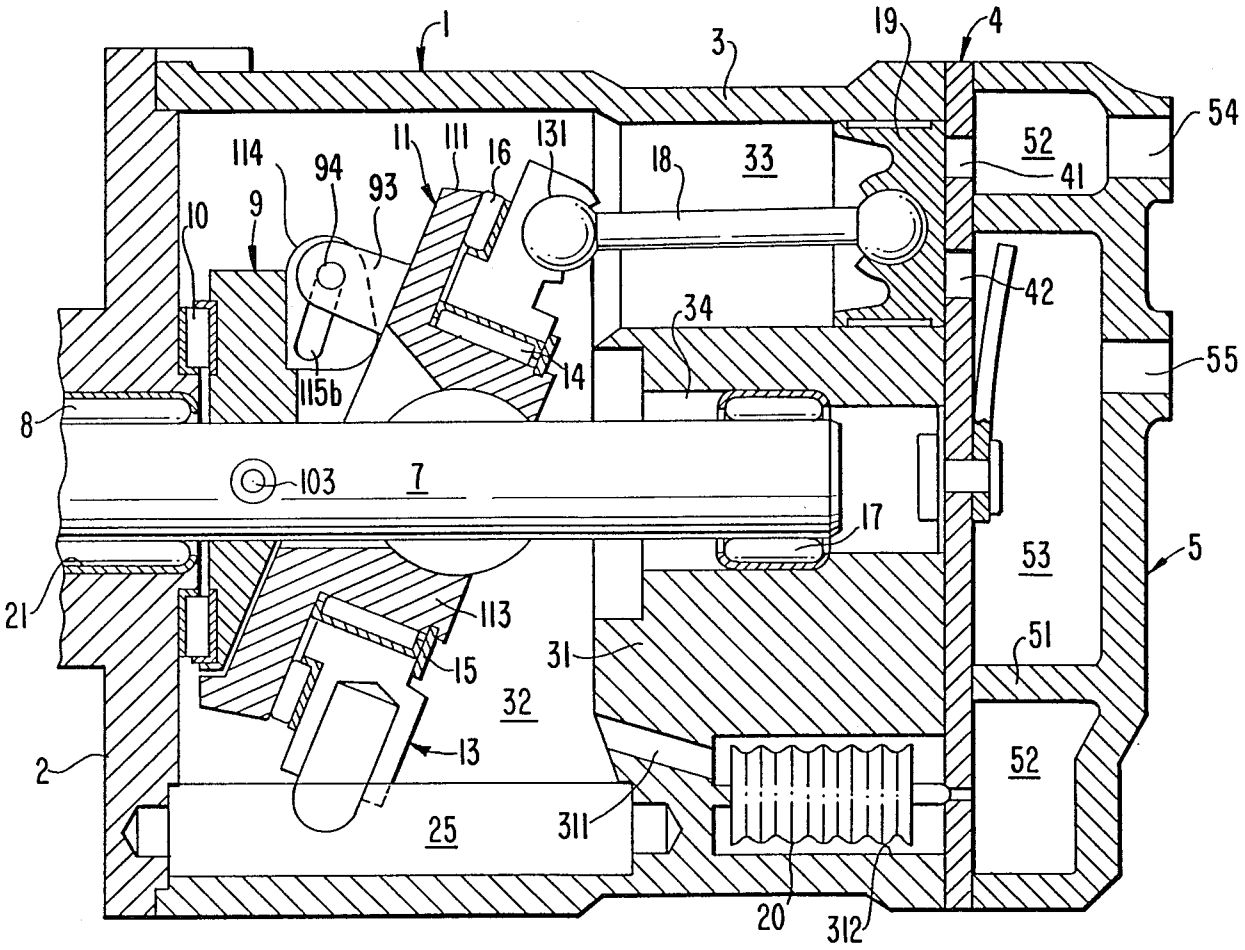
FIG. 9 is a cross-sectional view of a wobble plate compressor with a variable displacement mechanism in accordance with another embodiment of this invention.
Figure 10:
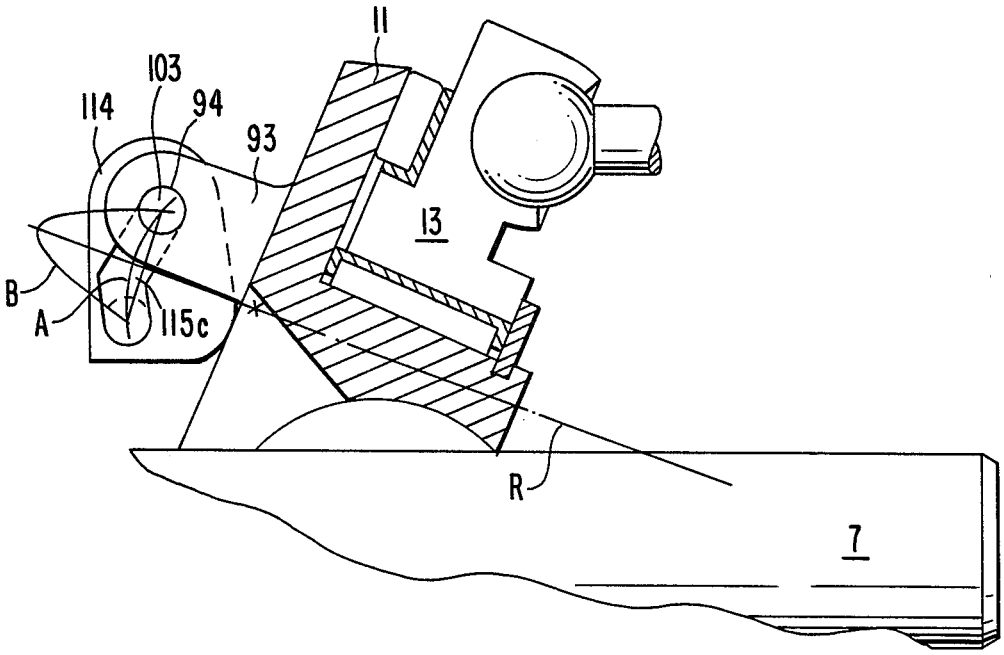
FIG. 10 is a cross-sectional view of the hinge mechanism of a wobble plate compressor with a variable displacement mechanism in accordance with another embodiment of this invention.

As shown in FIGS. 3–5, the elongated hole is arc-shaped and has a radius of curvature having a center disposed on the top outer surface of drive shaft 7. Other configurations for the elongated hole are possible. For example, the elongated hole may be straight or L-shaped. Straight elongated hole 115*b* is shown in FIG. 9, and L-shaped elongated hole 115*c* is shown in FIG. 10. In these configurations, the ends of the elongated hole are located along an arc similar to that for the elongated holes of FIGS. 3–5. However, in all elongated hole configurations, the center of the radius of curvature need not be on the top outer surface of drive shaft 7. This location is simply one preferred location. Any location below the center of the connecting portion of wobble plate 13 will work. Also, the arc need not be circular as long as the ends of an elongated hole are along an arc having a central radius extending below the center of the wobble plate connecting portion. This relationship is illustrated in FIG. 10 by the circular arc A, the non-circular arc B, and the common radii lines R.

Figure 1:
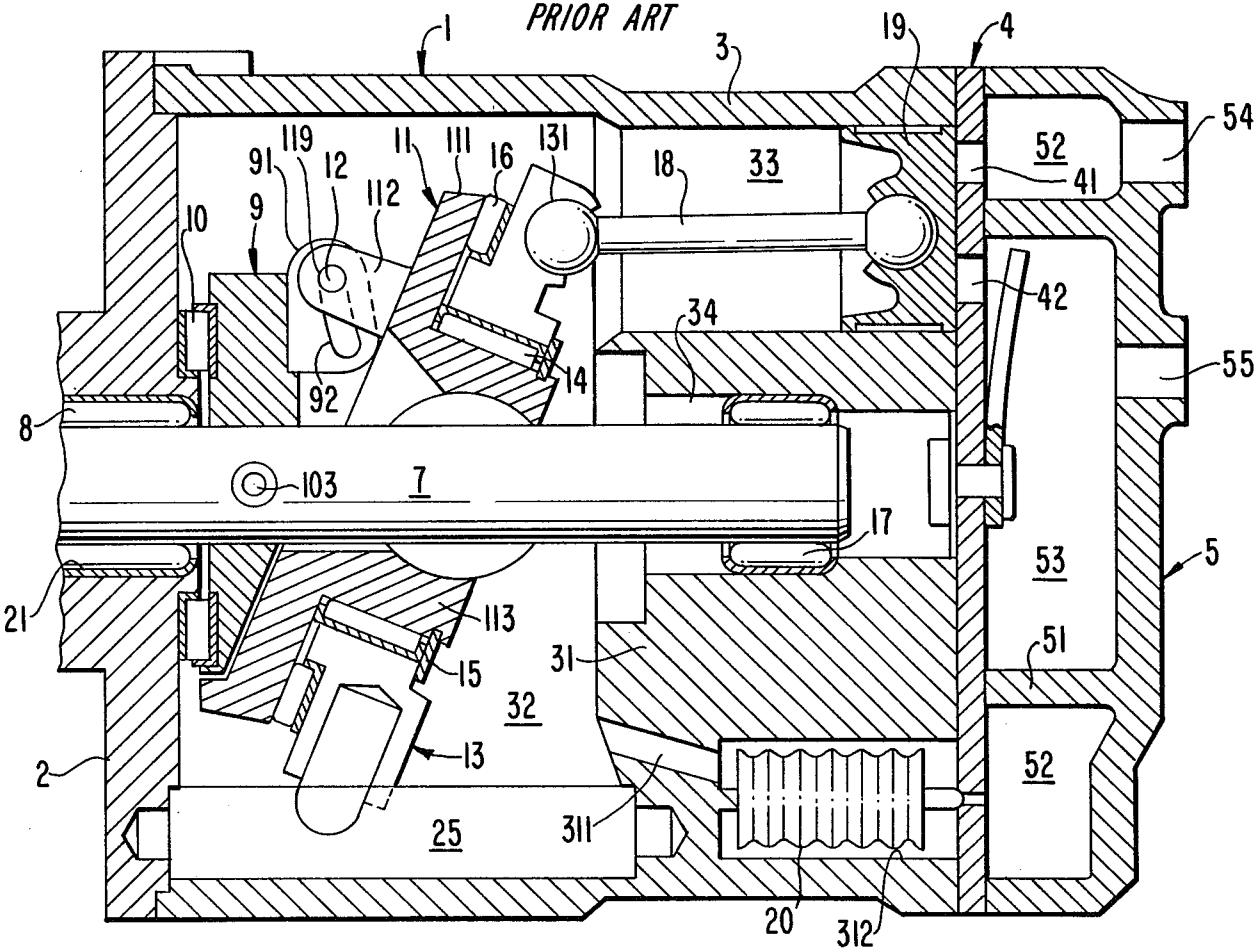
FIG. 1 PRIOR ART
FIG. 1 is a cross-sectional view of a conventional wobble plate compressor with a variable displacement mechanism, showing the largest angle of the inclined plate.

Furthermore, the same efficiency can be achieved by using an elongated hole according to the invention with the conventional hinge mechanism shown in FIGS. 1 and 2. This embodiment is shown in FIG. 9 using a straight elongated hole. Elongated hole 115*b* is placed on cam rotor 9. Its ends lie on an arc having a central radius extending below the center of the connecting portion or receiving surface of wobble plate 13. In a preferred embodiment as shown, the center is located adjacent the top outer surface of drive shaft 7.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

It will be appreciated that the relative directions used in the disclosure refer to the specific orientations of the figures. If other pistons are illustrated, or if a different sectional view of the compressor is used, the directions would change; the concepts remain the same.

I claim:

1. In a wobble plate compressor with a variable displacement mechanism, said compressor including a compressor housing with a crank chamber and a cylinder block in which a plurality of cylinders are formed; a drive shaft rotatably supported in said housing; a rotor fixed on said drive shaft and hingedly connected to an inclined plate through a hinge mechanism, said inclined plate disposed at an angle to a plane perpendicular to said drive shaft; said hinge mechanism including a first arm portion formed on said rotor, a second arm portion having an elongated hole formed on said inclined plate, and a guide pin extending from said first arm portion; a wobble plate disposed adjacent said inclined plate, said wobble plate converting rotational motion of said inclined plate into nutational motion; and a plurality of pistons coupled to said wobble plate through a plurality of piston rods, each piston being reciprocatingly fitted within a respective one of said cylinders and having a stroke volume variable according to the variation of the angle of said inclined plate; a top clearance of each said piston at a minimum when the angle of said inclined plate is largest and said top clearance of each said piston at a maximum when the angle of said inclined plate is smallest; the improvement comprising: the ends of said elongated hole lying along a uniform arc, the center of radius of said arc located below the center of the connecting portion between said piston rods and said wobble plate when the angle of said inclined plate is a maximum.

2. The wobble plate compressor of claim 1 wherein said central radius extends below said center of the connecting portion between said piston rods and said wobble plate when the angle of said inclined plate is a minimum.

3. The wobble plate compressor of claim 1 wherein said arc is symmetrical around, and said central radius is colinear with, a line perpendicular to the line segment between said ends of said elongated hole.

4. The wobble plate compressor of claim 1 wherein said arc is symmetrical around, and said central radius is colinear with, a line perpendicular to the line segment between said ends of said elongated hole.

5. The wobble plate compressor of claim 1 wherein said arc is circular.

6. The wobble plate compressor of claim 5 wherein said center of the radius of curvature of said circular arc is located adjacent the top side of said drive shaft when the angle of said inclined plate is a maximum.

7. The wobble plate compressor of claim 1 wherein said arc is circular.

8. The wobble plate compressor of claim 7 wherein said center of the radius of curvature of said circular arc is located adjacent the top side of said drive shaft.

9. In a wobble plate compressor with a variable displacement mechanism, said compressor including a compressor housing with a crank chamber and a cylinder block in which a plurality of cylinders are formed; a drive shaft rotatably supported in said housing; a rotor fixed on said drive shaft and hingedly connected to an inclined plate through a hinge mechanism, said inclined plate disposed at an angle to a plane perpendicular to said drive shaft; said hinge mechanism including a first arm portion formed on said inclined plate, a second arm portion having an elongated hole formed on said rotor, and a guide pin extending from said first arm portion; a wobble plate disposed adjacent said inclined plate, said wobble plate converting rotational motion of said inclined plate into nutational motion; and a plurality of piston coupled to said wobble plate through a plurality of piston rods, each piston being reciprocatingly fitted within a respective one of said cylinders and having a stroke volume variable according to the variation of the angle of said inclined plate; a top clearance of each said piston is a minimum when the angle of said inclined plate is largest and said top clearance of each said piston is a maximum when the angle of said inclined plate is smallest; the improvement comprising: the ends of said elongated hole lying along a uniform arc having a central radius extending below the center of the connecting portion between said piston rods and said wobble plate.

10. The wobble plate compressor of claim 1, 2, 6, 9, or 8 wherein said elongated hole is arc-shaped.

11. The wobble plate compressor of claim 1, 2, 6, 9, or 8 wherein said elongated hole is straight.

12. The wobble plate compressor of claim 1, 2, 6, 9, or 8 wherein said elongated hole is L-shaped.

13. In a wobble plate compressor with a variable displacement mechanism, said compressor including a compressor housing with a crank chamber and a cylinder block in which a plurality of cylinders are formed; a drive shaft rotatably supported in said housing; an inclined plate disposed on said drive shaft at an angle to a plane perpendicular to said drive shaft; a rotor fixed on said drive shaft and hingedly connected to said inclined plate through a hinge mechanism disposed therebetween and allowing the angle to be varied; said hinge mechanism including a first arm portion having a guide pin extending therefrom and a second arm portion having an elongated hole formed therein, said pin extending through said elongated hole; a wobble plate nutatably disposed on said inclined plate; a plurality of pistons coupled to said wobble plate by piston rods, each said piston being reciprocatingly fitted within a respective one of said cylinders and having a stroke volume variable according to the variation of the angle of said inclined plate; rotation of said drive shaft, said rotor and said inclined plate causing said wobble plate to nutate, nutational motion of said wobble plate causing reciprocating motion of said pistons in said cylinders; the top clearance of each said piston at a minimum when the angle of said inclined plate is largest and the top clearance of each said piston at a maximum when the angle of said inclined plate is smallest, the improvement comprising:

the ends of said elongated hole lying along a uniform arc, the center of radius of the arc located below the center of a connecting portion between said piston rods and said wobble plate when the angle of said inclined plate is at a maximum.

14. The wobble plate compressor of claim 13 wherein the center of radius is located below the center of the connecting portion between said piston rods and said wobble plate when the angle of said inclined plate is at a minimum.

15. The wobble plate compressor of claim 13 wherein said arc is symmetrical, and the radius is colinear with a line perpendicular to a line segment between said ends of said elongated hole.

16. The wobble plate compressor of claim 13 wherein said arc is circular.

17. The wobble plate compressor of claim 13, the center of radius located adjacent the top side of said drive shaft when the angle of said inclined plate is a maximum.

18. The wobble plate compressor of claim 13 wherein said elongated hole is arc-shaped.

19. The wobble plate compressor of claim 13 wherein said elongated hole is straight.

20. The wobble plate compressor of claim 13 wherein said elongated hole is L-shaped.

* * * * *